US005303655A

United States Patent [19]

Summa et al.

[11] Patent Number: 5,303,655

[45] Date of Patent: Apr. 19, 1994

[54] AUTOMATIC STABILIZER UNIT FOR FREE TROLLEY HAVING VERTICALLY MOVABLE WHEELS RESONSIVE TO TRACKSIDE RAILS

[75] Inventors: Gareth D. Summa, Denver, Mo.; Darrel D. Hespe, Olathe, Kans.

[73] Assignee: Mid-West Conveyor Company, Inc., Kansas City, Kans.

[21] Appl. No.: 951,873

[22] Filed: Sep. 28, 1992

[51] Int. Cl.[5] ..... E01B 5/04

[52] U.S. Cl. ..... 104/140; 104/172.3; 104/243; 198/345.3

[58] Field of Search ..... 104/139, 140, 172.1, 104/172.3, 243; 105/215.1; 198/345.3

[56] References Cited

U.S. PATENT DOCUMENTS

| | | | |
|---|---|---|---|
| 90,432 | 5/1869 | Devlan | 104/243 |
| 3,415,202 | 12/1968 | Dehne | 104/242 |
| 3,518,946 | 3/1983 | Kavieff | 104/172.3 |
| 4,408,540 | 10/1983 | Dehne | 104/172.3 |
| 4,438,701 | 3/1984 | Murai et al. | 104/172.3 |
| 4,440,090 | 4/1984 | Murai et al. | 104/172.3 X |
| 4,616,570 | 10/1986 | Dehne | 104/172.3 |
| 4,671,184 | 6/1987 | Fukuda | 104/140 X |
| 4,691,640 | 9/1987 | Murai | 104/140 |
| 4,811,685 | 3/1989 | Murai | 104/173.2 X |
| 5,058,504 | 10/1991 | Lenkeit et al. | 104/243 |

FOREIGN PATENT DOCUMENTS

| | | | |
|---|---|---|---|
| 126655 | 2/1992 | Japan | 104/281 |
| 2073691 | 10/1981 | United Kingdom | 104/140 |

*Primary Examiner*—Robert J. Oberleitner
*Assistant Examiner*—S. Joseph Morano
*Attorney, Agent, or Firm*—Litman, McMahon & Brown

[57] ABSTRACT

An automatic stabilizing unit for a free trolley and a load carriage in an inverted power and free conveyor system is connected to the free trolley. The stabilizing unit includes a stabilizer actuator which extends above a free track containing the free trolley from beneath the floor of a building which houses the conveyor, and a stabilizing gear mounted on the load carriage. At locations in an assembly plant, such as robotic welders or riveting stations where load shifting tolerances are critical, there must be additional stabilization of the load carriage. At these locations, stabilizing rails are positioned on top of the free track in line with stabilizing trucks on the stabilizing actuator. When the stabilizing trucks contact the rails, the trucks are urged upward, pushing an attached piston upward against a spring which causes a pair of stabilizing wheels on the stabilizing gear to rotate downward into contact with the factory floor, thus stabilizing the carriage only when needed.

13 Claims, 2 Drawing Sheets

AUTOMATIC STABILIZER UNIT FOR FREE TROLLEY HAVING VERTICALLY MOVABLE WHEELS RESONSIVE TO TRACKSIDE RAILS

BACKGROUND OF THE INVENTION

The present invention relates to an automatic stabilizer unit for free trolleys and attached load carriages in an inverted power and free conveyor system.

Power and free conveyor systems for moving bulky items through a manufacturing or assembly plant are well known. In a power and free conveyor, there are a power and a free conveyor track, generally disposed vertically with respect to each other. The "power" track is generally an endless chain with pusher members periodically inserted within the chain. These pusher members are closely confined within the power track and each one includes a driving "dog" which is oriented to engage a "free" trolley. The dog may or may not be selectively retractable.

A plurality of free trolleys travel within the "free" or carrier track which follows the same path as the power track but is spaced vertically relative thereto. At least some of the free trolleys include a driving member which can selectively engage the dog on a corresponding pusher member within the power track. The original power and free conveyor systems were suspension systems with the power track disposed above the free track. Loads to be carried on the conveyor system were suspended beneath the free trolleys in the free track. These suspension systems have reached a high degree of sophistication and can include features such as the ability to stop and accumulate free trolleys in specific accumulating areas and transfer zones which include intersections where loads can be transferred between conveyor systems.

More recently, in response to the specific requirements of the automobile industry, floor mounted or "inverted" power and free systems have been developed. In these inverted systems, the power track and the free track are disposed beneath the floor of the factory, with the free track positioned above the power track. A plurality of load carriages are attached to the free trolleys through a slot in the floor. Each load carriage is usually attached to two or more free trolleys with the load carriage being disposed above the floor and driven along the conveyor path by associated free trolleys.

These inverted systems have the capability of handling bulkier and heavier loads, such as automobile chassis, while minimizing many dangerous conditions found in suspension systems. For example, inverted systems allow workers to safely climb on and off of the load carriages and they eliminate the danger inherent in the swinging loads of suspension systems.

At the same time, the development of inverted systems has presented a new and unique series of problems to designers. In a large factory, a single power and free conveyor can run for a mile or more. In a conveyor of this length there may be literally hundreds of power members and associated free trolleys and load carriages. In such a system, even a small amount of unnecessary drag in each trolley and carriage has an enormous cumulative effect on the system. Thus, even the provision of free castering stabilizing wheels on each load carriage would add an unacceptable amount of drag to the system. Thus, load carriages are often connected directly to the trolleys via shafts extending through the slot in the floor and disposed along the center line of the load carriages with the load carriages themselves not contacting the floor at all.

However, manufacturing facilities, such as automobile assembly plants, which use inverted power and free systems often include numerous automated assembly stations such as robotic welders and riveters. At such stations, alignment between the automobile chassis to be welded and the robotic equipment is critical, often With tolerances within thousandths of an inch. At such points, it is absolutely necessary for the load carriages in the conveyor to be stabilized. This is particularly true since, at these same stations, it is common for workers to climb onto and off of the carriages, thus introducing destabilizing forces which are multiplied by the moment arm presented by any displacement of the worker's position from the centerline of the carriages.

A designer, then, is faced with a dilemma. Stabilizing wheels which contact the floor surface under the outboard load components of a carriage add an unacceptable amount of drag to a conveyor system, but stabilization is needed when the load carriages and loads are positioned at critical assembly line stations such as robotic welders and riveters.

It is clear then, that a need exists for a stabilizing system for an inverted power and free conveyor which can be selectively engaged to provide stabilization for the loads and load carriages as they approach conveyor stations which include robotic assembly stations or the like with consequent close stabilization tolerance requirements. At the same time, such a stabilizing system should not include carriage wheels which constantly contact the floor surface, since the cumulative drag from wheels on all of the load carriages would be unacceptable.

SUMMARY OF THE INVENTION

The present invention is directed to a stabilizing unit for a free trolley and attached load carriage in an inverted power and free conveyor system including a stabilizer actuator.

The stabilizing actuator is normally disposed above the free track, but below the floor surface of the factory and comprises a pair of stabilizer trucks, each of which includes a free castering wheel, with the two stabilizer trucks connected at opposite ends of an axle disposed within an axle housing. The axle housing is connected to a piston which extends upward through a slot in the factory floor. The stabilizing actuator is attached to an upper portion of an associated free trolley which is directly connected to a lower portion of the free trolley in the free track via a vertically oriented shaft. Each stabilizer truck is pivotally connected to the upper portion of said free trolley via a pivot arm. A fixed arm connects the free trolley upper portion to a vertically oriented sleeve which surrounds the piston which is free to travel vertically within the sleeve.

A load carriage is disposed above the factory floor and is designed to carry an item in an assembly line, e.g. an automobile chassis. The load carriage is connected to the free trolley upper portion via a shaft which is vertically aligned with the shaft connecting the upper portion with the lower portion of the free trolley. Under normal conditions, the load carriage is wholly supported by the shaft, i.e. no portion of the carriage contacts the factory floor.

The stabilizing unit also includes a stabilizer gear attached to the load carriage and disposed above the floor. The stabilizer gear comprises a pair of stabilizer wheels disposed on either end of an axle. The axle is contained within an axle housing which is, in turn, connected to an arm. The arm is affixed to a shaft which shaft which is rotatably connected to the load carriage. A lever arm is also affixed to the shaft with the lever arm terminating in a cam head which is disposed above the top of the piston in the stabilizer unit. A coil spring is placed between the top Of the cam head and the bottom of the load carriage to urge the cam head downward. The action of the spring urges the cam head downward which causes the lever arm to rotate the shaft. This, in turn, urges the axle and connected stabilizer Wheels upward and out of contact with the factory floor during carriage operation which does not require stabilization.

At positions in the conveyor where load carriage and free trolley stabilization is required, such as in machine or robotic assembly stations, a pair of stabilizer rails are positioned in an alignment so as to engage the stabilizer trucks on the stabilizer actuator. The stabilizer rails are normally positioned on top of the free track but below the factory floor and each rail is vertically tapered at the leading and trailing edge.

When the stabilizer trucks encounter the stabilizer rails, the trucks ride up the tapered leading edge and roll along the rail. This action forces the connected piston upward. The piston, which has a cam surface at its upper end, in turn, urges the cam head of the stabilizer gear upward against the action of the coil spring. This causes the lever arm to rotate the shaft in the opposite direction which causes the axle and connected stabilizer wheels to rotate downward and into contact with the factory floor. Thus, as long as the stabilizer rails continue, the load carriage is effectively stabilized by the stabilizer wheels.

Subsequent to passage of the carriage past the robotic assembly station, the stabilizer rails are ended, with the trailing edge also being tapered to allow a smooth transition. At this point, the stabilizer trucks are again lowered, thus lowering the piston and allowing the coil spring to urge the cam head downward, raising and removing the stabilizer wheels from contact with the factory floor.

The inventive stabilizer unit incorporates a minimal number of working parts, is relatively inexpensive, acts to relieve the effects of centrifugal forces on the load carriages and free trolleys of the inverted power and free conveyor system, while providing stabilization in the conveyor system only at needed points, thus greatly reducing drag within the system.

OBJECTS AND ADVANTAGES OF THE INVENTION

The principal objects of the present invention are: to provide an improved stabilizer unit for an inverted power and free conveyor system; to provide such a stabilizer unit which includes a minimal number of separate working parts; to provide such a stabilizer unit which reliably provides stabilization as needed within the conveyor system while minimizing drag; to provide such a stabilizer unit in which a pair of stabilizing trucks each contact a selectively placed stabilizing rail so as to operably urge a pair of stabilizing wheels into contact with an associated factory floor to provide additional support; to provide such a stabilizer unit which is inexpensive to manufacture and produce and which is easily repairable; and to provide such a stabilizer unit which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
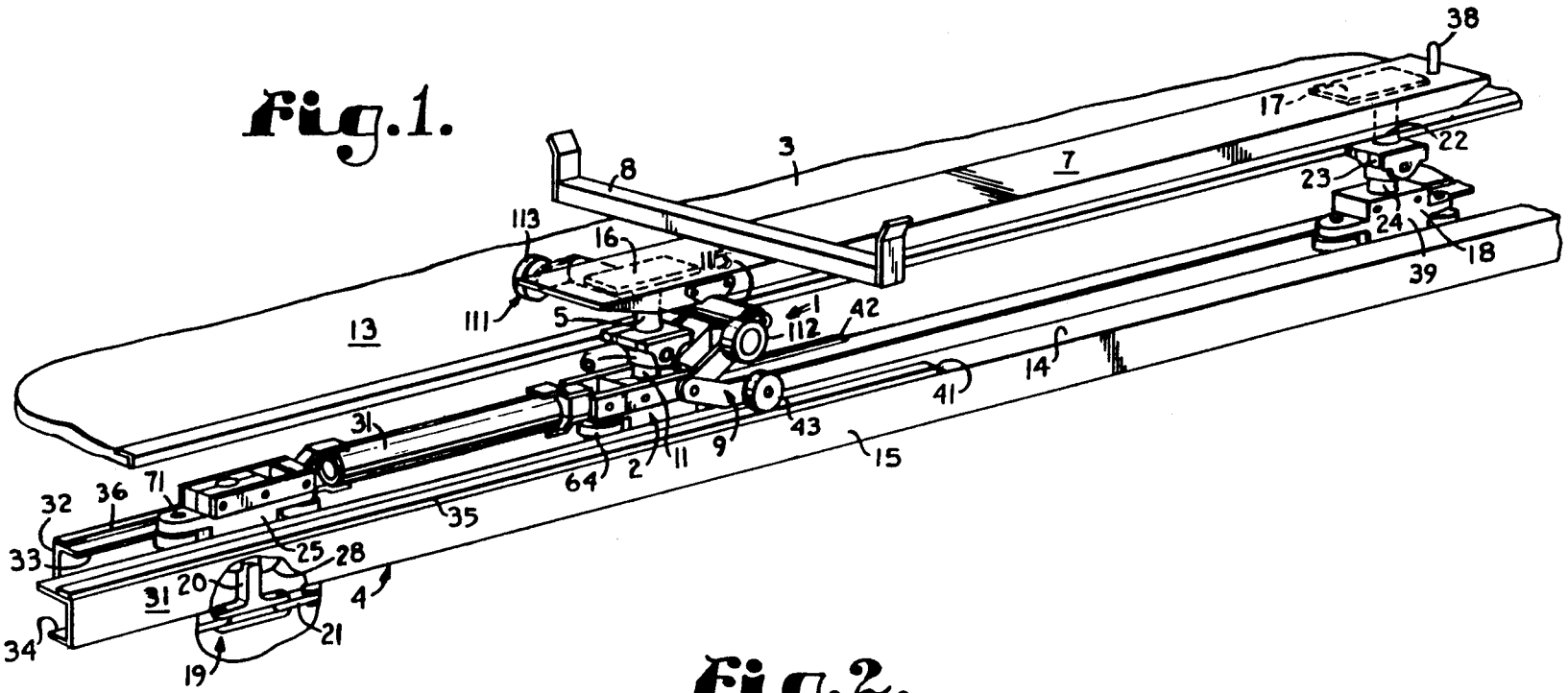
FIG. 1 is a perspective view of a portion of an inverted power and free conveyor system with a stabilizer unit in accordance with the present invention connected to a free trolley and to a load carriage, and with portions broken away to show detail thereof.

Referring to FIG. 1, the reference numeral 1 generally indicates a stabilizer unit which comprises a stabilizing actuator 9 connected to a stabilizing free trolley 2 and a biased bell crank or stabilizing gear assembly 111 which is attached to a load carriage 3 in an inverted power and free conveyor system, a portion of which is shown in FIG. 1, and which is generally indicated by the reference numeral 4.

The portion of the conveyor system illustrated in FIG. 1 is at a point just prior to entering a robotic assembly station, with the stabilizing free trolley 2 traveling within a free track 15 and being pulled by a driven free trolley 25 in a direction right to left in the Figure. The load carriage 3 is supported by the stabilizing free trolley 2 and by a trailing free trolley 18. A power track 19 is shown in FIG. 1 beneath the driver free trolley 25 and runs generally the length of the free track 15. In FIG. 1 the free track 15, is broken away to illustrate an engagement between a driving dog 20 extending upward from a driven endless chain 21 of the power track 19 and a hold back dog 28 on the driven free trolley 25. The hold back dog 28 can be selectively moved upward and out of contact with the driving dog 20 in a conventional fashion, when it is desired to leave the load carriage 3 stationary.

In the inverted power and free conveyor 4, the load carriage 3 comprises a platform 7 with a front load supporting outrigger 8 and a rear load engaging peg 38. A pair of support plates 16 and 17 are welded or otherwise attached beneath the platform 7. The front support plate 16 is connected to a universal joint 6 on the stabilizing free trolley 2 via a first vertically oriented shaft 5. The universal joint 6 is pivotally connected to a solid frame 63 on the stabilizing free trolley 2 via a second vertically oriented shaft 11 which is aligned with the shaft 5. The first shaft 5 extends through a slot 12 (FIG. 5) in the floor 13 of a factory or other facility. A pair of flaps 26 and 27 cover the slot 12 to prevent dirt and debris from falling into the slot, but are resilient enough to allow the first shaft 5 to advance along the conveyor path 4 with minimal resistance. Thus, the load carriage 3 is disposed above the factory floor 13 while the stabilizer actuator 9 is positioned beneath the floor 13 and above the top surface 14 of the free track 15. The load carriage 3 is connected to the trailing free trolley 18 via the rear support plate 17 which is connected to a third vertically oriented shaft 22. The trailing free trolley 18 includes a rear universal joint 23 connected to the third shaft 22 and a fourth vertically oriented shaft 24 connected to a Wheeled platform 39.

The stabilizing free trolley 2 is connected to the driven free trolley 25 via a horizontally oriented shaft 31. Each of the free trolleys 2, 18, and 25 travel within the free track 15 which comprises opposing "C" shaped channel members 31 and 32 which are separated to form a top slot 33 and a bottom slot 34. Each of the free trolleys 2, 18, and 25, operate in essentially the same manner, and only the stabilizing free trolley 2 will be described in detail with respect to FIGS. 2-5.

Figure 2:
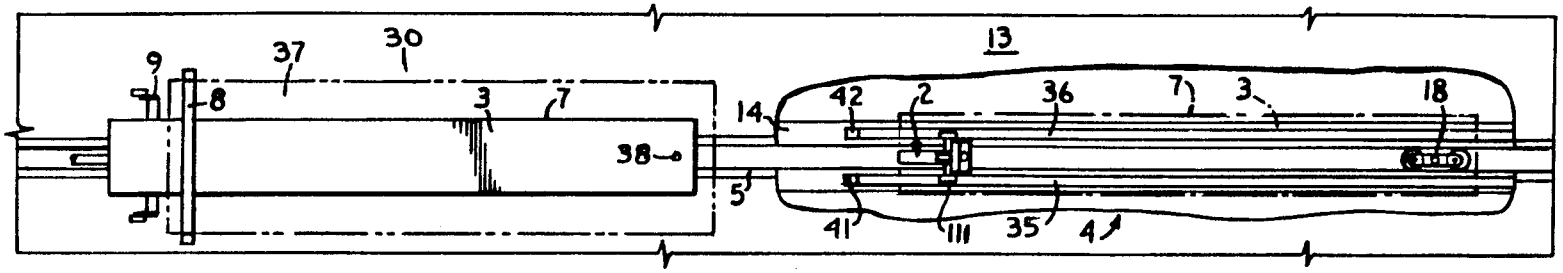
FIG. 2 is a top plan view of a pair of load carriages, one of which is shown in phantom lines and is traversing a critical robotic assembly station in the inverted power and free conveyor system, with the view of the load carriage traversing the critical assembly station being a cross-section taken along line 2—2 of FIG. 1 and with the floor partially out away to show the top of the free track.

FIG. 2 shows a portion of the power and free conveyor 4 which includes a robotic assembly station 30 or other critical tolerance position in the conveyor, such as a curved track section of the conveyor 4. A load carriage 3 is shown being pulled from right to left, in phantom traversing the robotic assembly station position on the right side. The carriage 3 is shown in solid lines on the left carrying a load 37, illustrated in phantom lines. The load 37 may be an automobile chassis, for example. Note that the load 37 extends laterally to the limits of the outrigger 8, thus presenting considerable weight outboard of the center line of the carriage 3. The carriage 3 On the right is shown in phantom lines and the factory floor 13 shown partially broken away to show the free track 15. A pair of functional cams or stabilizing rails 35 and 36 (FIGS. 1 and 2) are shown mounted on the top of the free track 15 and extending through the robotic assembly station position. The leading ends of the stabilizing rails 35 and 36 include tapered portions 41 and 42 to permit a pair of cam followers or stabilizing trucks 43 and 44, respectively, to achieve a smooth transition between the top of the free track 15 and the stabilizing rails 35 and 36. Likewise, the trailing ends of the rails 35 and 36 include the tapered portions 41 and 42.

Figure 4:
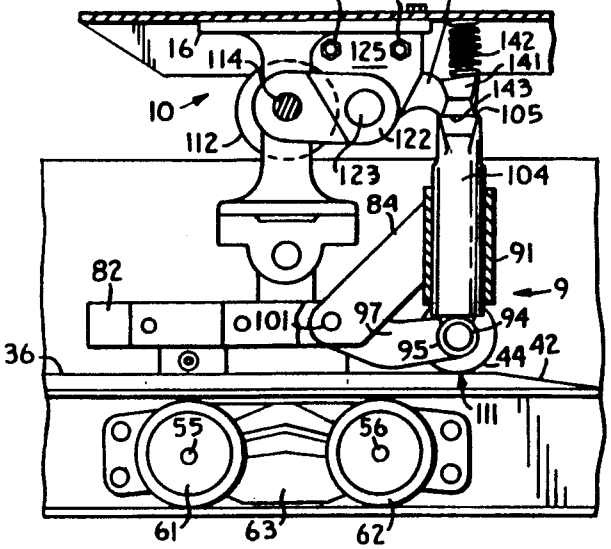
FIG. 4 is an enlarged side elevational view of the stabilizer unit and free trolley, with the load carriage in a stabilized condition, and with portions broken away to show detail thereof.
Figure 3:
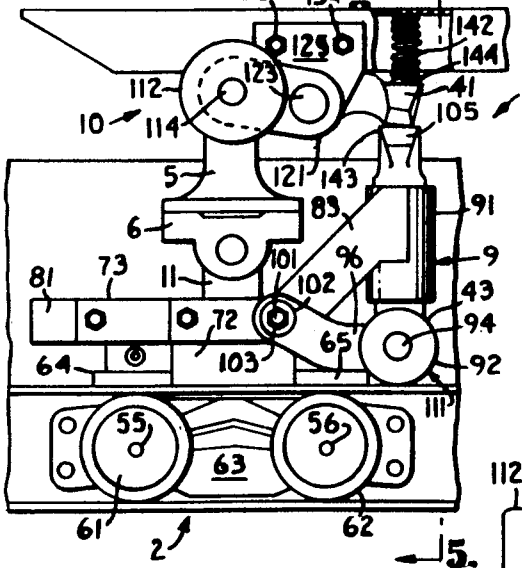
FIG. 3 is an enlarged side elevational view of the stabilizer unit and free trolley, with the load carriage in a non-stabilized condition and with portions broken away to show detail thereof.
Figure 5:
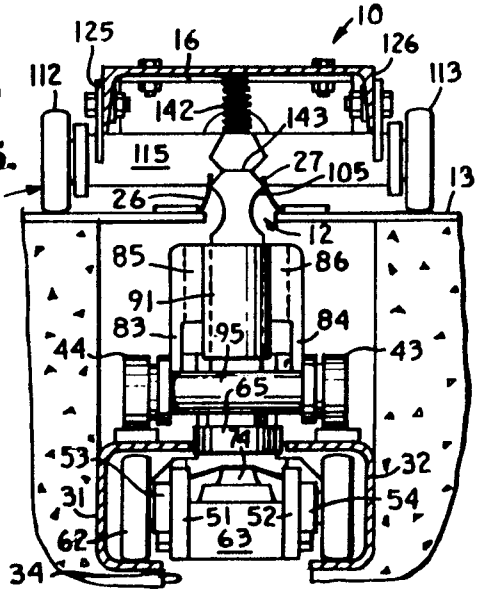
FIG. 5 is an enlarged cross-sectional view of the stabilizer unit and free trolley, taken along the line 5—5 of FIG. 3, with the load carriage in a stabilized condition and with a piston thereof shown in phantom lines within the vertically oriented sleeve.

Referring to FIGS. 3-5, the stabilizing free trolley 2 is shown traveling within the free track 15. The stabilizing free trolley 2 comprises a pair of spaced side plates 51 and 52, each of which has a pair of axle supporting attachments 53 and 54. A pair of axles 55 and 56 extend through the supporting attachments 53 and 54. A pair of wheel sets 61 and 62 are supported by the axles 55 and 56, respectively. The wheel sets 61 and 62 are closely confined within the C channels 31 and 32 and are operative to roll freely as the trolley 2 is pulled along the free track 15. A solid frame 63 is supported by the spaced side plates 51 and 52, and front and rear guide rollers 64 and 65 are supported on corresponding stub axles 71 (shown on the driven free trolley 25 in FIG. 1) mounted on frame extension 73 of an upper block 72. The guide rollers 64 and 65 have a diameter slightly less than the width of the free track upper slot 33 and they engage the inner surfaces of the slot 33 to give lateral stability to the trolley 2.

The upper block 72 is connected to the solid frame 63 via a shaft 74 which extends through the upper slot 33. The upper block 72 is also connected to the universal joint 6 via the second vertical shaft 11 which, in turn, supports the carriage 3 via the first vertical shaft 5 and the front support plate 16.

The frame extension 73 comprises a pair of spaced elongated plates 81 and 82 attached to either side of the block 72. Each plate 81 and 82 includes an upward angled portion 83 and 84, respectively. The angled portions 83 and 84 terminate in inward facing brackets 85 and 86, respectively, which form a portion of the stabilizer actuator 9. The brackets 85 and 86 support a vertically oriented sleeve 91 between them. The pair of stabilizer trucks 43 and 44 are attached to an axle 94 supported within an axle housing 95. The axle housing 95 is rigidly attached to one end of a pair of arms 96 and 97, which are pivotally attached at their other ends to the frame extension 73 via a through bolt 101, a washer 102 and a nut 103. Thus, the sleeve 91 is fixed relative to the frame extension 73, but the arms 96 and 97 are free to pivot relative thereto. A piston 104 is attached to the top center of the axle housing 95 and extends upward through the sleeve 91 and the slot 12 in the floor 13, terminating in a cam surface 105.

The load carriage 3 includes a stabilizer gear 111 which comprises a pair of stabilizer wheels 112 and 113 which are connected at either end of an axle 114 extending through an axle housing 115. The axle housing 115 is rigidly attached to one end of a pair of arms 121 and 122. The other end of each of the arms 121 and 122 is rigidly attached to a rotatable shaft 123 which extends through a pair of plates 125 and 126. The plates 125 and 126 are each attached to the platform 7 of the carriage 3 via bolts 131 and 132 and mating nuts 133 and 134. A lever arm 135 which terminates in a cam head 141 is also rigidly attached near the center of the rotatable shaft 123. The cam head 141 has a lower cam surface 143 which engages the cam surface 105 of the piston 104 and an upper surface 144. A coil spring 142 is attached to the bottom of the platform 7 and is aligned with the top of the Cam head 141 so as to contact and bias against the upper surface 144. The coil spring 142 normally urges the cam head 141 downward, causing the lever arm 135 to rotate the shaft 123 clockwise, as shown in FIG. 3, which raises the stabilizer gear 111 out of contact with the floor 13.

The operation of the stabilizer unit 2 will now be described with reference to FIGS. 1-5. At points in the conveyor path where stabilization is needed, such as at the robotic assembly station position depicted in FIG. 2, the stabilizing rails 35 and 36 are placed on the top surface 14 of the free track 15. The trailing and leading edges of the rails 35 and 36 include the tapered edges as shown at 41 and 42 in FIG. 2. As the stabilizing free trolley 2 is pulled past the robotic assembly station, the stabilizing trucks 43 and 44 roll up the tapered ends 41 and 42 and onto the stabilizing rails 35 and 36, respectively. The stabilizer trucks 43 and 44 urge the connected piston 104 upward, causing the cam surface 105 to engage the lower cam surface 143 of the cam head 141, pushing the cam head 141 upward against the action of the coil spring 142. This causes the lever arm 135 to rotate the rotatable shaft 123 counterclockwise, as shown in FIG. 4. The rotatable shaft 123 then forces the arms 121 and 122 downward, causing the stabilizing wheels 112 and 113 to contact the floor 13, as shown in FIGS. 4 and 5. The substantial length of the axle 114 places the stabilizer wheels 112 and 113 on the floor 13 considerably outside of the free trolley 2. The wheels 112 and 113 thus stabilize the load carriage 3 against any shifts which could compromise an assembly step being accomplished at the robotic assembly station. As the carriage 3 exits the robotic assembly station, the stabilizing rails 35 and 36 are terminated, allowing the stabilizer wheels 112 and 113 to roll back down to the level of the top surface 14 of the free track 15, and lowering the piston 104. This causes the coil spring 142 to again urge the cam head 141 downward, causing the lever arm 133 to rotate the shaft 123 clockwise, again as shown in FIG. 3, which raises the stabilizer gear 111 out of contact with the floor 13. With the stabilizing gear 111 thus raised, it presents no drag to the conveyor 4, thus greatly increasing the efficiency and lowering the power required to run the conveyor 4. While the stabilizer trucks 43 and 44 have been illustrated as in contact with the top surface 14 of the free track 15, the trucks 43 and 44 could be positioned just above the top surface 14, when not needed to lower the stabilizer wheels 112 and 113, so as to eliminate drag from them as well.

While the stabilizer unit 1 has been shown and described in connection with an inverted power and free conveyor system, it could readily be adapted to a conventional power and free system where stabilizing wheels or other elements are employed.

It is to be understood that while certain forms of the present invention have been illustrated and described herein, it is not to be limited to the specific forms or arrangement of parts described and shown.

What is claimed and desired to be secured by Letters Patent is as follows:

1. A stabilizer apparatus for a conveyor including a load carriage and comprising:

(a) stabilizing means connected to said load carriage, normally assuming a nonstabilizing position, and vertically movable, relative to said load carriage, to a stabilizing position; and (b) actuating means being responsive to stabilizing rail means positioned at selected conveyor locations where stabilization is needed for causing said stabilizing means to move to said stabilizing position to stabilize said carriage only at said selected locations.

2. An apparatus in accordance with claim 1, wherein:

(a) said stabilizing means comprises at least one stabilizing wheel, said load carriage traversing the top of a floor; and (b) said actuating means causes said stabilizing wheel to contact said floor in said stabilizing position only along said locations.

3. An apparatus in accordance with claim 1, wherein:

(a) said conveyor is an inverted power and free conveyor which includes a free track; and (b) said actuating means is operably positioned between said free track and the floor of a building in which said conveyor is located.

4. An apparatus in accordance with claim 3, wherein:

(a) said conveyor includes at least one free trolley operating within said free track; and (b) said actuating means is connected to said free trolley.

5. A method of stabilizing a load carriage in an inverted power and free conveyor system in a building having a floor, comprising the steps of:

(a) placing mechanically extendible an retractable stabilizing means on said load carriage;

(b) placing stabilizing rail means means only at selected locations along said conveyor system where stabilization is needed to extend said stabilizing means so as to contact the floor only at said selected locations;

(c) mechanically extending said stabilizing means responsive to said stabilizing rail means to thereby stabilize said load at said selected locations; and (d) mechanically retracting said stabilizing means at locations other than said selected locations.

6. A method in accordance with claim 5, wherein said stabilizing means comprise a pair of laterally extending stabilizing wheels on an axle within an axle housing, said conveyor system includes a free track running beneath said floor within which free trolleys are propelled by actuators in a power track, and said load carriages are attached to said free trolleys, said placing step includes the step of:

(a) placing at least one stabilizing rail on top of said free tracks at said conveyor locations.

7. A stabilizer apparatus for an inverted power and free conveyor, wherein said conveyor includes at least one free trolley operating within a free track operably located beneath the floor of a building in which the conveyor is located, and a load carriage attached to said free trolley but operably disposed above said floor, said stabilizer apparatus comprising;

(a) stabilizing means attached to said load carriage and comprising a pair of stabilizing wheels connected to opposite ends of a first axle within a first axle housing, a first lever arm which is connected at one end to said first axle housing and to a rotating shaft connected to said load carriage at the other end, and a second lever arm connected to said rotating shaft, said second lever arm terminating in a cam head that is normally urged downward by a coil spring;

(b) actuating means connected to said free trolley, said actuating means causing said stabilizing wheels to contact said floor only at selected locations along said conveyor where stabilization is needed.

8. An apparatus in accordance with claim 7, wherein said actuating means comprises:

(a) a pair of stabilizing trucks attached at either end of a second axle within a second axle housing and adapted to roll along the top of said free track;

(b) a piston attached to said second axle housing and aligned with said cam head, said piston adapted to extend through a slot in the floor and terminating in a cam surface which is in contact with a lower cam surface on said cam head;

(c) a pair of stabilizing rails attached to the top of said free track at said locations along said conveyor where additional stabilization is required, each of said stabilizing rails being aligned with a respective one of said stabilizing trucks; whereby (d) said stabilizing trucks are forced upward by said stabilizing rails at said conveyor locations, said trucks and said second axle housing urging said piston upward against said cam head, that subsequently urges said cam head against said spring, rotating said rotatable shaft that urges said first axle housing downward via said first lever arm so that said stabilizing wheels contact said floor to stabilize said load carriage.

9. A stabilizer apparatus for an inverted power and free conveyor including a free track, said apparatus comprising:

(a) stabilizing means attached with a load carriage;

(b) actuating means for causing said stabilizing means to stabilize said carriage only at selected locations along said conveyor where stabilization is needed;

(c) said actuating means being operably positioned between said free track and the floor of a building in which said conveyor is located;

(d) said conveyor including at least one free trolley operating within said free track;

(e) said actuating means being connected to said free trolley; and (f) said stabilizer means including:

(1) a pair of stabilizing wheels positioned laterally on opposite sides of said free trolley and being connected to opposite ends of a first axle within a first axle housing;

(2) a first lever arm which is connected to said first axle at one end and to a pivoting shaft connected to said carriage at the other end; and (3) a second lever arm connected to said pivoting shaft, said second lever arm terminating in a cam head which is normally urged downward by a coil spring.

10. An apparatus in accordance with claim 7, wherein said actuating means comprises:

(a) a pair of stabilizing trucks attached at either end of a second axle and adapted to roll along the top of said free track;

(b) a piston attached to said second axle housing and aligned with said cam head, said piston operably extending through a slot in the floor and terminating in a cam surface that is in contact with a lower cam surface on said cam head;

(c) a pair of camming stabilizing rails attached to the top of said free track at said locations along said conveyor where additional stabilization is required, each of said stabilizing rails being aligned with a respective one of said stabilizing trucks; whereby (d) said stabilizing trucks are cammed upward by said stabilizing rails at said conveyor locations, said trucks forcing said piston upward against said cam head, that subsequently urges said cam head against said spring, rotating said rotatable shaft which urges said first axle housing downward via said first lever arm so that said stabilizing wheels contact said floor to stabilize said load carriage.

11. A method of stabilizing a load carriage in an inverted power and free conveyor system in a building having a floor, said conveyor system including a free track running beneath said floor within which free trolleys are propelled by actuators in a power track and load carriages are attached to said free trolleys, said method comprising the steps of:

(a) placing retractable stabilizing means on a load carriage, said stabilizing means including a pair of laterally extending stabilizing wheels on an axle within an axle housing;

(b) placing stabilizer actuating means only at locations along said conveyor system where stabilization is needed to extend said stabilizing means so as to contact the floor only at said locations;

(c) said placing retractable stabilizing means step includes the step of:

(1) placing at least one stabilizing rail on top of said free track at the conveyor locations;

(d) attaching at least one stabilizing truck to at least some of said free trolleys, each of said stabilizing trucks being aligned with a respective stabilizing rail and riding thereon at said conveyor locations; and (e) connecting a piston to said stabilizing trucks, said piston extending through a slot in said floor to an extending means on said stabilizing means, whereby said stabilizing truck urges said piston upward at said conveyor locations, causing said extending means to extend said stabilizing wheels.

12. In a power and free conveyor system wherein a load carriage is supported along a central axis thereof by at least two trolleys that follow a truck and wherein the track is curved at selected locations therealong, the improvement comprising:

(a) stabilizing means for laterally supporting said carriage while passing one of said locations and operably not supporting said carriage during transit along said track except at said locations;

(b) activator means for engaging said stabilizer means along said locations;

(c) said stabilizing means including a pair of support wheels located on either side of said track; and (d) said activator means including a cam along said location and a cam follower connected to said wheels by a biased crank assembly so as to operable lower said wheels during passage along said locations.

13. A stabilizer apparatus for a load supported above a floor surface by a trolley movable along track means of conveyor means positioned below said floor surface, said apparatus comprising:

(a) a pair of stabilizer wheel arms pivotally connected to said trolley in laterally spaced relation on opposite sides of said trolley and pivotable between a nonstabilizing position and a stabilizing position;

(b) a respective stabilizing wheel rotatably mounted on each of said arms, the wheels engaging said floor surface in said stabilizing position of said arms to laterally stabilize said load;

(c) an elongated stabilizing cam rail extending along a section of said track means at which it is desired to stabilize said load; and (d) cam follower means pivotally connected to said trolley, drivingly connected to said arms, and operative to cause said arms to be moved to said stabilizing position upon said cam follower means engaging said cam rail and otherwise causing said arms to assume said nonstabilizing position.

* * * * *